US010920394B2

(12) United States Patent
Kobayashi et al.

(10) Patent No.: US 10,920,394 B2
(45) Date of Patent: Feb. 16, 2021

(54) CONSTRUCTION MACHINE

(71) Applicant: HITACHI CONSTRUCTION MACHINERY CO., LTD., Tokyo (JP)

(72) Inventors: Hiroyuki Kobayashi, Tokyo (JP); Hiroshi Sakamoto, Tsuchiura (JP); Yoshiyuki Tsuchie, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 233 days.

(21) Appl. No.: 16/082,552

(22) PCT Filed: Sep. 20, 2017

(86) PCT No.: PCT/JP2017/033832
§ 371 (c)(1),
(2) Date: Sep. 6, 2018

(87) PCT Pub. No.: WO2018/056289
PCT Pub. Date: Mar. 29, 2018

(65) Prior Publication Data

US 2019/0040605 A1 Feb. 7, 2019

(30) Foreign Application Priority Data

Sep. 23, 2016 (JP) ..... 2016-185209

(51) Int. Cl.
*E02F 9/22* (2006.01)
*E02F 9/20* (2006.01)
*E02F 3/43* (2006.01)

(52) U.S. Cl.
CPC ..... *E02F 3/43* (2013.01); *E02F 9/20* (2013.01); *E02F 9/2221* (2013.01); (Continued)

(58) Field of Classification Search
None
See application file for complete search history.

(56) References Cited

U.S. PATENT DOCUMENTS 4,881,450 A 11/1989 Hirata et al.
5,933,346 A * 8/1999 Brabec ..... E02F 9/2025 340/684

(Continued)

FOREIGN PATENT DOCUMENTS

CN 105339558 A 2/2016
EP 0 284 167 A1 9/1988

(Continued)

OTHER PUBLICATIONS

Extended European Search Report received in corresponding European Application No. 17853059.8 dated Mar. 27, 2020.

(Continued)

*Primary Examiner* — Redhwan K Mawari
*Assistant Examiner* — Melanie J Patrick
(74) *Attorney, Agent, or Firm* — Mattingly & Malur, PC

(57) ABSTRACT

Lever neutrality is determined by whether or not operation levers are at a neutral position based on operation signals from operation levers. Pilot pressures are computed based on the operation signals from the operation levers; and pilot pressure signals are converted to current signals. A current interruption controller controls interruption and communication of the current signals to the solenoid proportional valves; and an operating condition is determined by determining whether a construction machine is in a manual operation state or a semiautomatic operation state. At least one hydraulic actuator is controlled to assist the operation of the operator, and when it is determined that the construction machine is in the semiautomatic operation state, the current interruption controller interrupts the current signals to all of the solenoid proportional valves only when it is determined that all the operation levers are at the neutral position.

4 Claims, 11 Drawing Sheets

(52) U.S. Cl.
CPC ..... *E02F 9/2267* (2013.01); *E02F 9/2271* (2013.01); *E02F 9/2285* (2013.01)

(56) References Cited

U.S. PATENT DOCUMENTS

| | | | | |
|---|---|---|---|---|
| 2008/0155977 | A1* | 7/2008 | Kim | E02F 9/2285 60/420 |
| 2015/0233086 | A1* | 8/2015 | Takaura | E02F 9/2285 414/685 |
| 2015/0308078 | A1* | 10/2015 | Lee | F15B 11/006 701/50 |
| 2015/0308081 | A1* | 10/2015 | Takaura | E02F 9/262 701/50 |
| 2015/0361641 | A1* | 12/2015 | Urbanowicz | E02F 3/32 414/687 |
| 2016/0281331 | A1 | 9/2016 | Ikegami et al. | |

FOREIGN PATENT DOCUMENTS

| | | | |
|---|---|---|---|
| JP | 01-097729 | A | 4/1989 |
| JP | 2011-43002 | A | 3/2011 |
| WO | 2014/013877 | A1 | 1/2014 |
| WO | 2016/111205 | A1 | 7/2016 |

OTHER PUBLICATIONS

International Preliminary Report on Patentability received in corresponding International Application No. PCT/JP2017/033832 dated Apr. 4, 2019.

International Search Report of PCT/JP2017/033832 dated Dec. 19, 2017.

Chinese Office Action received in corresponding Chinese Application No. 201780014256.X dated May 22, 2020.

* cited by examiner

CONSTRUCTION MACHINE

TECHNICAL FIELD

The present invention relates to a construction machine.

BACKGROUND ART

A hydraulic excavator which is a construction machine is equipped with a lower track structure capable of self-traveling, an upper swing structure swingably provided on top of the lower track structure, and a work device connected to the upper swing structure. The work device is equipped, for example, with a boom rotatably connected to the upper swing structure, an arm rotatably connected to the boom, and a bucket rotatably connected to the arm. Through the driving of a plurality of hydraulic actuators (more specifically, a boom cylinder, an arm cylinder, and a bucket cylinder), the boom, the arm, and the bucket are rotated. Each hydraulic actuator is driven by a hydraulic fluid supplied from a hydraulic pump via a directional control valve. The directional control valve is driven by an operation device operated by an operator, and controls the flow rate and direction of the hydraulic fluid supplied to each hydraulic actuator in accordance with the driving amount.

As the operation device operated by the operator, a hydraulic pilot type device and an electric lever type device are available. The hydraulic pilot type operation device has a plurality of pilot valves corresponding to the operational directions (e.g., front, rear, left, and right) from a neutral position of an operation lever and generating a pilot pressure in accordance with the operation amount of the operation lever. For example, there may be provided a pilot valve controlling a boom directional control valve in the front-rear operational direction, and a pilot valve controlling an arm directional control valve in the right-left operational direction. Each pilot valve outputs a pilot pressure to the operation portion (pressure receiving portion) of the corresponding directional control valve, and drives the directional control valve.

The electric lever type operation device has a plurality of potentiometers corresponding to operational directions (e.g., front, rear, left, and right) from the neutral position of the operation lever and generating operation signals (electric signals) in accordance with the operation amount of the operation lever. The operation device generates command currents in accordance with operation signals from the potentiometers, and outputs command currents to the solenoid portions of corresponding solenoid proportional valves to drive solenoid proportional valves. The solenoid proportional valves generate pilot pressures in proportion to the command currents and output the pilot pressures to operation portions (pressure receiving portions) of corresponding directional control valves to drive the directional control valves.

In the hydraulic excavator, it sometimes occurs that the hydraulic actuators are abruptly brought to a stop due to an abrupt lever operation of the operator. Generally speaking, in the boom operation which involves a large inertial mass, in the case where the operator abruptly brings back the operation lever to neutral to cause an abrupt stop, the machine body undergoes violent vibration, resulting in deterioration in stability. In view of this, in the hydraulic pilot type operation device, there is provided a shockless valve in the pilot hydraulic circuit to cause the pilot pressures to undergo a gentler change. In contrast, in the electric lever type operation device, the controller drives the solenoid proportional valves in accordance with the operation lever signals to control the pilot pressures. There has been disclosed a technique in which in the case of an abrupt stop, control is performed so as to cause a gentle change in the pilot pressure with respect to the operation lever signal, thereby stopping the machine body in a stable manner (see, for example, Patent Document 1).

On the other hand, in the electric lever type operation device, the pilot pressures are electronically controlled by the solenoid proportional valves, so that when the lever is neutral, it is necessary that the pilot pressures should be interrupted to quickly bring the machine body to a stop. For example, there has been disclosed a technique in which there is provided a switch detecting a neutral position with respect to each operational direction (front, rear, left, right) of the electric lever, and in which a controller controls a current interruption device in accordance with the switch signal, whereby when the switch is neutral, the drive current in the solenoid proportional valve of the hydraulic actuator corresponding to each operational direction is completely interrupted, thus achieving an improvement in terms of the reliability of the function thereof (see, for example, Patent Document 2).

Further, in recent years, the computerization of the construction sites has progressed, and a machine control technique is being put into practical use according to which a hydraulic actuator is controlled by using information on the target surface and the bucket claw tip provided from an external system for conducting a construction management and the like and in which the operation of the operator is assisted semi-automatically. For example, the boom is automatically controlled such that the bucket claw tip does not get over the target surface, whereby it is possible for the operator to perform excavation with high accuracy along the target surface semi-automatically solely through arm operation (see, for example, Patent Document 3).

PRIOR ART DOCUMENT

Patent Document

Patent Document 1: International Publication No. WO2014/013877
Patent Document 2: JP-1989-97729-A
Patent Document 3: JP-2011-43002-A

SUMMARY OF THE INVENTION

Problem to be Solved by the Invention

The semiautomatic control like the machine control described in Patent Document 3 adopts an electric lever type operation device, whereby, as compared with the conventional hydraulic pilot system, it is possible to achieve a great merit in terms of construction accuracy and man-hour reduction.

However, when, in an electric lever type operation device, the current interruption when the lever is neutral is executed for each hydraulic actuator as described in Patent Document 2, in the case where the operator solely operates the arm, it becomes impossible to automatically control the boom through semiautomatic control, so that it is impossible to excavate with high accuracy along the target surface.

The present invention has been made in view of the above-described situation. It is an object of the present invention to provide a construction machine which, in a semiautomatic control such as machine control, helps to secure the safety of the machine body while permitting control intervention.

Means for Solving the Problem

To solve the above problem, there is provided, for example, a structure as described in the claims. The present application includes a plurality of means for solving the above problem, an example of which is a construction machine including: a plurality of hydraulic actuators; a plurality of operation levers corresponding to the plurality of hydraulic actuators; a plurality of operation lever devices outputting electric operation signals in accordance with operation amounts of the plurality of operation levers; a plurality of solenoid proportional valves connected to a hydraulic circuit driving each of the plurality of hydraulic actuators; and a controller inputting therein the operation signals and computing control signals for the solenoid proportional valves and outputting the control signals; characterized in that the controller includes: a lever neutrality determination section determining whether or not the operation levers are at a neutral position based on operation signals from the operation lever devices; a pilot pressure computing section computing pilot pressures driving the hydraulic actuators based on the operation signals from the operation lever devices; a command current computing section converting the pilot pressure signals computed by the pilot pressure computing section to current signals to the solenoid proportional valves; a current interruption control section controlling interruption and communication of the current signals from the command current computing section to the solenoid proportional valves; and an operation state determination section determining whether the construction machine is in a manual operation state in which all of the plurality of hydraulic actuators are an object of manual operation by an operator, or in a semiautomatic operation state in which, based on a positional relationship between a bucket claw tip position and a construction target surface, at least one hydraulic actuator of the plurality of hydraulic actuators is controlled to assist the operation of the operator; and in the case where the operation state determination section determines that the construction machine is in the semiautomatic operation state, the current interruption control section interrupts the current signals to all of the plurality of solenoid proportional valves only when it is determined that all the operation levers of the plurality of operation lever devices are at the neutral position.

Effect of the Invention

According to the present invention, at the time of semiautomatic control, it is possible to secure the safety of the machine body while permitting control intervention.

MODES FOR CARRYING OUT THE INVENTION

In the following, an embodiment of the construction machine of the present invention will be described with reference to the drawings.

Figure 1:
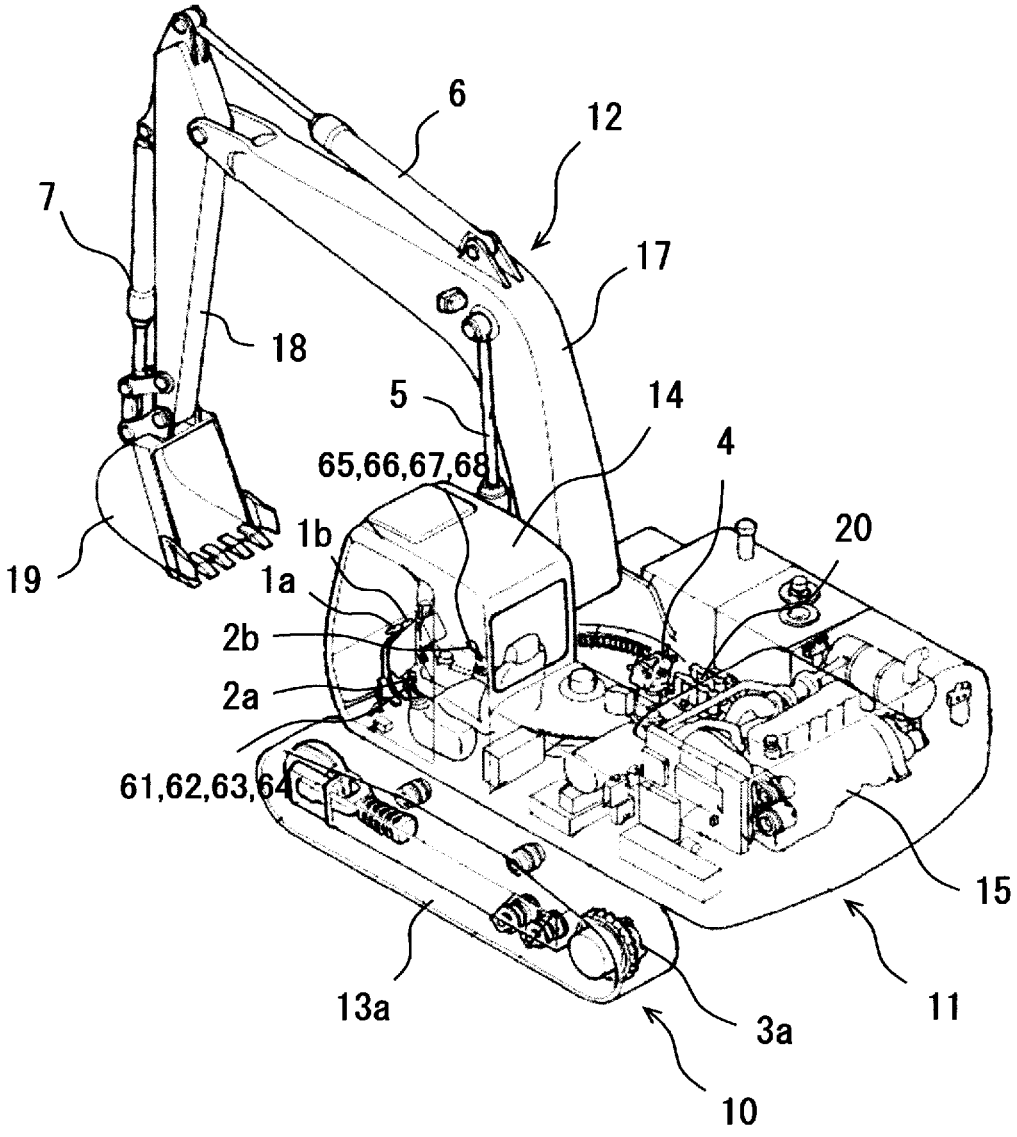
FIG. 1 is a perspective view of a hydraulic excavator equipped with an embodiment of the construction machine of the present invention.

FIG. 1 is a perspective view of a hydraulic excavator equipped with an embodiment of the construction machine of the present invention. As shown in FIG. 1, the hydraulic excavator is equipped with a lower track structure 10 capable of self-traveling, an upper swing structure 11 swingably provided on top of the lower track structure 10, and a work device (front implement) 12 connected to the front side of the upper swing structure 11. The lower track structure 10 is equipped with left and right crawler type traveling devices 13*a* and 13*b* (the drawing only shows the left traveling device 13*a*). In the left traveling device 13*a*, through the forward or backward rotation of the left traveling motor 3*a*, the left crawler runs in the forward or backward direction. Similarly, in the right traveling device 13*b*, through the forward or backward rotation of the right traveling motor 3*b* (see FIG. 2), the right crawler runs in the forward or backward direction. In this way, the lower track structure 10 travels.

The upper swing structure 11 swings to the left or right through the rotation of a swing motor 4. In the front portion of the upper swing structure 11, there is provided a cab 14, and in the rear portion of the upper swing structure 11, there are mounted apparatuses such as an engine 15. Inside the cab 14, there are provided traveling operation devices 1*a* and 1*b* and work operation devices 2*a* and 2*b*. At the doorway for getting on and off the cab 14, there is provided a vertically operable gate lock lever 16 (see FIG. 2 below). When the gate lock lever 16 is operated to an ascent position, the getting on and off of the operator is allowed, and when it is operated to a descent position, the getting on and off of the operator is hindered.

A work device 12 is equipped with a boom 17 rotatably connected to the front side of the upper swing structure 11, an arm 18 rotatably connected to the boom 17, and a bucket 19 rotatably connected to the arm 18. The boom 17 rotates upwardly or downwardly through the expansion or contraction of a boom cylinder 5. The arm 18 rotates in a crowding direction (retracting direction) or a dumping direction (extruding direction) through the expansion or contraction of an arm cylinder 6. The bucket 19 rotates in the crowding direction or dumping direction through the expansion or contraction of a bucket cylinder 7. Further, each of the boom 17, the arm 18, and the bucket 19 is provided with a posture sensor (not shown).

A control valve 20 serves to control the flow (flow rate and direction) of a hydraulic fluid supplied to the hydraulic actuators such as the boom cylinder 5 described above from hydraulic pumps 8*a*, 8*b*, and 8*c* described below.

The work operation device 2*a* is equipped with first through fourth potentiometers (61 through 64), and the work operation device 2*b* is equipped with fifth through eighth potentiometers (65 through 68).

Figure 2:
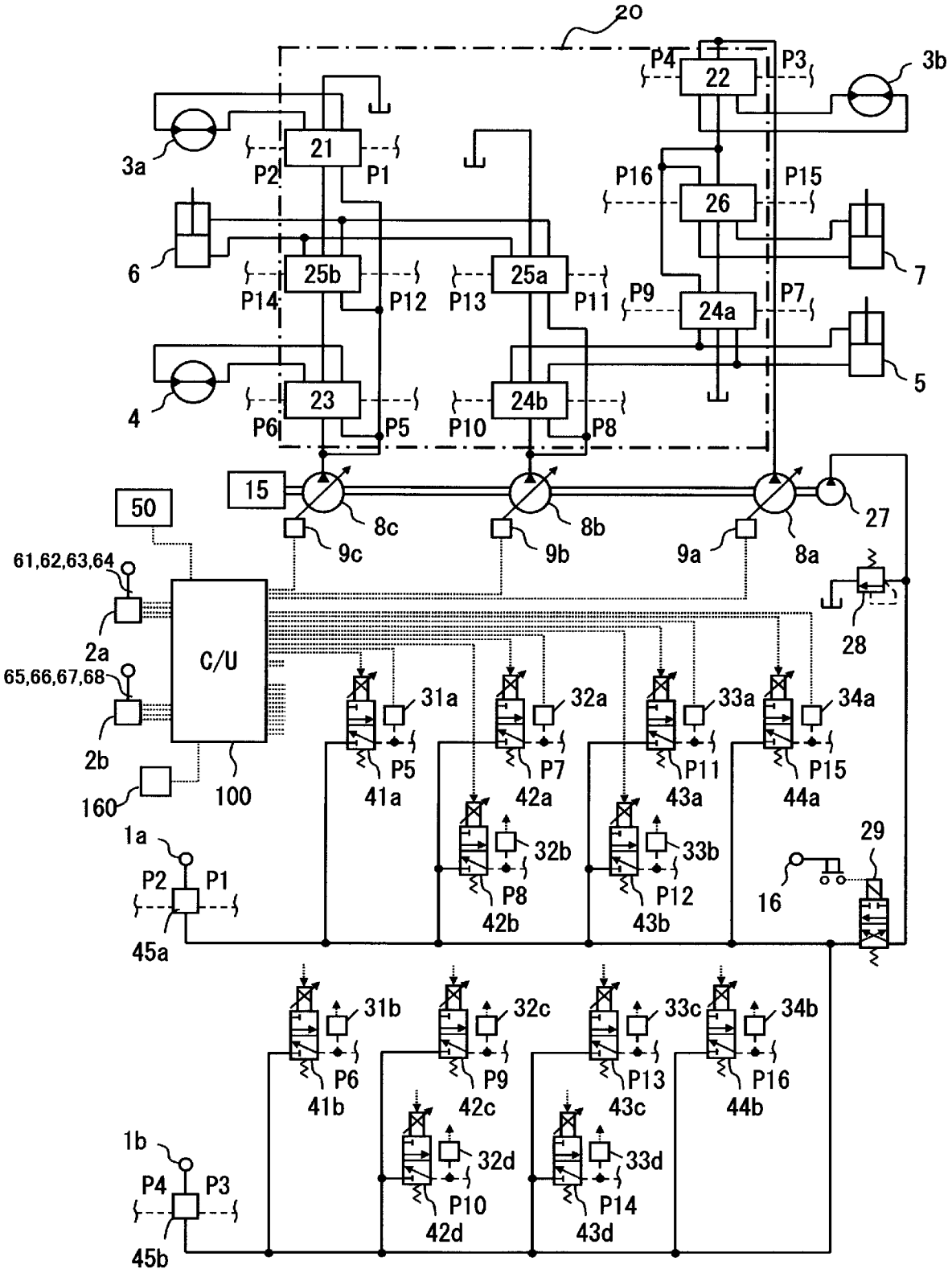
FIG. 2 is a schematic diagram illustrating a drive system of a hydraulic excavator equipped with an embodiment of the construction machine of the present invention.

FIG. 2 is a schematic diagram illustrating a drive system of a hydraulic excavator equipped with an embodiment of the construction machine of the present invention. In FIG. 2, for the sake of convenience, a main relief valve, a load check valve, a return circuit, a drain circuit, etc. are omitted.

Roughly speaking, the drive system of the present embodiment is composed of a main hydraulic control circuit and a pilot pressure circuit.

The control valve 20, which is the main hydraulic control circuit, is equipped with variable displacement type hydraulic pumps 8*a*, 8*b*, and 8*c* driven by the engine 15, a plurality of hydraulic actuators (more specifically, the left traveling motor 3*a*, the right traveling motor 3*b*, the swing motor 4, the boom cylinder 5, the arm cylinder 6, and the bucket cylinder 7), and a plurality of hydraulic pilot type directional control valves (more specifically, a left traveling directional control valve 21, a right traveling directional control valve 22, a swing directional control valve 23, boom directional control valves 24*a* and 24*b*, arm directional control valves 25*a* and 25*b*, and a bucket directional control valve 26). The hydraulic pumps 8*a*, 8*b*, and 8*c* are respectively provided with regulators 9*a*, 9*b*, and 9*c* varying the pump capacities.

All the directional control valves are center bypass type directional control valves. They are classified into a first valve group connected to the delivery side of the hydraulic pump 8*a*, a second valve group connected to the delivery side of the hydraulic pump 8*b*, and a third valve group connected to the delivery side of the hydraulic pump 8*c*.

The first valve group has the right traveling directional control valve 22, the bucket directional control valve 26, and the boom directional control valve 24*a*. The pump port of the right traveling directional control valve 22 is connected tandem to the pump port of the bucket directional control valve 26 and to the pump port of the boom directional control valve 24*a*. The pump port of the bucket directional control valve 26 and the pump port of the boom directional control valve 24*a* are connected in parallel to each other. As a result, a higher priority is given to the right traveling directional control valve 22 than to the bucket directional control valve 26 and the boom directional control valve 24*a* in the supply of the hydraulic fluid from the hydraulic pump 8*a*.

The second valve group has the boom directional control valve 24*b* and the arm directional control valve 25*a*. The pump port of the boom directional control valve 24*b* and the pump port of the arm directional control valve 25*a* are connected in parallel to each other. The third valve group has the swing directional control valve 23, the arm directional control valve 25*b*, and the left traveling directional control valve 21. The pump port of the swing directional control valve 23, the pump port of the arm directional control valve 25*b*, and the pump port of the left traveling directional control valve 21 are connected in parallel to each other.

The pilot pressure control circuit is equipped with a pilot pump 27 driven by the engine 15, the hydraulic pilot type traveling operation devices 1*a* and 1*b*, the electric lever type work operation devices 2*a* and 2*b*, a controller 100, a plurality of solenoid proportional valves (more specifically, swing solenoid proportional valves 41*a* and 41*b*, boom solenoid proportional valves 42*a*, 42*b*, 42*c*, and 42*d*, arm solenoid proportional valves 43*a*, 43*b*, 43*c*, and 43*d*, and bucket solenoid proportional valves 44*a* and 44*b*), a relief valve 28, and a gate lock valve 29.

The left traveling operation device 1*a* has an operation lever operable in the front-rear direction, and a pilot valve 45*a* generating a pilot pressure using the delivery pressure of the pilot pump 27 as the original pressure. The pilot valve 45*a* includes a first pilot valve and a second pilot valve.

The first pilot valve generates a pilot pressure in accordance with the front side operation amount from the neutral position of the operation lever, and outputs the pilot pressure to one side operation portion (pressure receiving portion) of the left traveling directional control valve 21 via the pilot line P1, thereby driving the spool of the left traveling directional control valve 21 to the other side. As a result, the hydraulic fluid from the hydraulic pump 8*c* is supplied to the left traveling motor 3*a* via the left traveling directional control valve 21 to rotate the left traveling motor 3*a* in the forward direction.

The second pilot valve generates a pilot pressure in accordance with the back side operation amount from the neutral position of the operation lever, and outputs the pilot pressure to the other side operation portion of the left traveling directional control valve 21 via the pilot line P2, thereby driving the spool of the left traveling directional control valve 21 to one side. As a result, the hydraulic fluid from the hydraulic pump 8*c* is supplied to the left traveling motor 3*a* via the left traveling directional control valve 21 to rotate the left traveling motor 3*a* in the backward direction.

Similarly, the right traveling operation device 1*b* has an operation lever operable in the front-rear direction, and a pilot valve 45*b* generating a pilot pressure using the delivery pressure of the pilot pump 27 as the original pressure. The pilot valve 45*b* includes a third pilot valve and a fourth pilot valve.

The third pilot valve generates a pilot pressure in accordance with the front side operation amount from the neutral position of the operation lever, and outputs the pilot pressure to one side operation portion of the right traveling directional control valve 22 via the pilot line P3, thereby driving the spool of the right traveling directional control valve 22 to the other side. As a result, the hydraulic fluid from the hydraulic pump 8*a* is supplied to the right traveling motor 3*b* via the right traveling directional control valve 22 to rotate the right traveling motor 3*b* in the forward direction.

The fourth pilot valve generates a pilot pressure in accordance with the back side operation amount from the neutral position of the operation lever, and outputs the pilot pressure to the other side operation portion of the right traveling directional control valve 22 via the pilot line P4, thereby driving the spool of the right traveling directional control valve 22 to one side. As a result, the hydraulic fluid from the hydraulic pump 8*a* is supplied to the right traveling motor 3*b* via the right traveling directional control valve 22 to rotate the right traveling motor 3*b* in the backward direction.

The left work operation device 2*a* has an operation lever operable in the front-rear direction and the right-left direction, and the first through fourth potentiometers (61 through 64). The first potentiometer 61 generates an operation signal (electric signal) in accordance with the front side operation amount from the neutral position of the operation lever, and the second potentiometer 62 generates an operation signal in accordance with the back side operation amount from the neutral position of the operation lever. The third potentiometer 63 generates an operation signal in accordance with the left side operation amount from the neutral position of the operation lever, and the fourth potentiometer 64 generates an operation signal in accordance with the right side operation amount from the neutral position of the operation lever. These operation signals (electric signals) generated are output to the controller 100. The first through fourth potentiometers are installed in twos with respect to each of the front, rear, left, and right directions. In the controller 100, the values of the two potentiometers are compared with each other, thereby enhancing the reliability of the lever signal.

Similarly, the right work operation device 2*b* has an operation lever operable in the front-rear direction and the right-left direction, and the fifth through eighth potentiometers (65 through 68). The fifth potentiometer 65 generates an operation signal in accordance with the front side operation amount from the neutral position of the operation lever, and the sixth potentiometer 66 generates an operation signal in accordance with the back side operation amount from the neutral position of the operation lever. The seventh potentiometer 67 generates an operation signal in accordance with the left side operation amount from the neutral position of the operation lever, and the eighth potentiometer 68 generates an operation signal in accordance with the right side operation amount from the neutral position of the operation lever. These operation signals (electric signals) generated are output to the controller 100. The fifth through eighth potentiometers are installed in twos with respect to each of the front, rear, left, and right directions. In the controller 100, the values of the two potentiometers are compared with each other, thereby enhancing the reliability of the lever signal.

The controller 100 generates a command current in accordance with the operation signal from the first potentiometer 61, and outputs the command current to the solenoid portion of the swing solenoid proportional valve 41*a* to drive the swing solenoid proportional valve 41*a*. The swing solenoid proportional valve 41*a* generates a pilot pressure using the delivery pressure from the pilot pump 27 as the original pressure, and outputs the pilot pressure to one side operation portion of the swing directional control valve 23 via the pilot line P5 to drive the spool of the swing directional control valve 23 to the other side. As a result, the hydraulic fluid from the hydraulic pump 8*c* is supplied to the swing motor 4 via the swing directional control valve 23 to rotate the swing motor 4 in one direction.

The controller 100 generates a command current in accordance with the operation signal from the second potentiometer 62, and outputs the command current to the solenoid portion of the swing solenoid proportional valve 41*b* to drive the swing solenoid proportional valve 41*b*. The swing solenoid proportional valve 41*b* generates a pilot pressure using the delivery pressure from the pilot pump 27 as the original pressure, and outputs the pilot pressure to the other side operation portion of the swing directional control valve 23 via the pilot line P6 to drive the spool of the swing directional control valve 23 to one side. As a result, the hydraulic fluid from the hydraulic pump 8*c* is supplied to the swing motor 4 via the swing directional control valve 23 to rotate the swing motor 4 in the opposite direction.

The pilot lines P5 and P6 are provided with swing pressure sensors 31*a* and 31*b*, and the actual pilot pressure detected by each pressure sensor is output to the controller 100.

The controller 100 generates a command current in accordance with the operation signal from the third potentiometer 63, and outputs the command current to the solenoid portions of the arm solenoid proportional valves 43*a* and 43*b* to drive the arm solenoid proportional valves 43*a* and 43*b*. The arm solenoid proportional valve 43*a* generates a pilot pressure using the delivery pressure from the pilot pump 27 as the original pressure, and outputs the pilot pressure to one side operation portion of the arm directional control valve 25*a* via the pilot line P11 to drive the spool of the arm directional control valve 25*a* to the other side. The arm solenoid proportional valve 43*b* generates a pilot pressure using the delivery pressure from the pilot pump 27 as the original pressure, and outputs the pilot pressure to one side operation portion of the arm directional control valve 25*b* via the pilot line P12 to drive the spool of the arm directional control valve 25*b* to the other side. As a result, the hydraulic fluid from the hydraulic pump 8*b* is supplied to the rod side of the arm cylinder 6 via the arm directional control valve 25*a*, and the hydraulic fluid from the hydraulic pump 8*c* is supplied to the rod side of the arm cylinder 6 via the arm directional control valve 25*b* to contract the arm cylinder 6.

The controller 100 generates a command current in accordance with the operation signal from the fourth potentiometer 64, and outputs the command current to the solenoid portions of the arm solenoid proportional valves 43*c* and 43*d* to drive the arm solenoid proportional valves 43*c* and 43*d*. The arm solenoid proportional valve 43*c* generates a pilot pressure using the delivery pressure from the pilot pump 27 as the original pressure, and outputs the pilot pressure to the other side operation portion of the arm directional control valve 25*a* via the pilot line P13 to drive the spool of the arm directional control valve 25*a* to one side. The arm solenoid proportional valve 43*d* generates a pilot pressure using the delivery pressure from the pilot pump 27 as the original pressure, and outputs the pilot pressure to the other side operation portion of the arm directional control valve 25*b* via the pilot line P14 to drive the spool of the arm directional control valve 25*b* to one side. As a result, the hydraulic fluid from the hydraulic pump 8*b* is supplied to the bottom side of the arm cylinder 6 via the arm directional control valve 25*a*, and the hydraulic fluid from the hydraulic pump 8*c* is supplied to the bottom side of the arm cylinder 6 via the arm directional control valve 25*b* to expand the arm cylinder 6.

The pilot lines P11, P12, P13, and P14 are provided with arm pressure sensors 33*a*, 33*b*, 33*c*, and 33*d*, and the actual pilot pressure detected by each pressure sensor is output to the controller 100.

The controller 100 generates a command current in accordance with the operation signal from the fifth potentiometer 65, and outputs the command current to the solenoid portions of the boom solenoid proportional valves 42*a* and 42*b* to drive the boom solenoid proportional valves 42*a* and 42*b*. The boom solenoid proportional valve 42*a* generates a pilot pressure using the delivery pressure from the pilot pump 27 as the original pressure, and outputs the pilot pressure to one side operation portion of the boom directional control valve 24*a* via the pilot line P7 to drive the spool of the boom directional control valve 24*a* to the other side. The boom solenoid proportional valve 42*b* generates a pilot pressure using the delivery pressure from the pilot pump 27 as the original pressure, and outputs the pilot pressure to one side operation portion of the boom directional control valve 24*b* via the pilot line P8 to drive the spool of the boom directional control valve 24*b* to the other side. As a result, the hydraulic fluid from the hydraulic pump 8*a* is supplied to the rod side of the boom cylinder 5 via the boom directional control valve 24*a*, and the hydraulic fluid from the hydraulic pump 8*b* is supplied to the rod side of the boom cylinder 5 via the boom directional control valve 24*b* to contract the boom cylinder 5.

The controller 100 generates a command current in accordance with the operation signal from the sixth potentiometer 66, and outputs the command current to the solenoid portions of the boom solenoid proportional valves 42*c* and 42*d* to drive the boom solenoid proportional valves 42*c* and 42*d*. The boom solenoid proportional valve 42*c* generates a pilot pressure using the delivery pressure from the pilot pump 27 as the original pressure, and outputs the pilot pressure to the other side operation portion of the boom directional control valve 24*a* via the pilot line P9 to drive the spool of the boom directional control valve 24*a* to one side. The boom solenoid proportional valve 42*d* generates a pilot pressure using the delivery pressure from the pilot pump 27 as the original pressure, and outputs the pilot pressure to the other side operation portion of the boom directional control valve 24*b* via the pilot line P10 to drive the spool of the boom directional control valve 24*b* to one side. As a result, the hydraulic fluid from the hydraulic pump 8*a* is supplied to the bottom side of the boom cylinder 5 via the boom directional control valve 24*a*, and the hydraulic fluid from the hydraulic pump 8*b* is supplied to the bottom side of the boom cylinder 5 via the boom directional control valve 24*b* to expand the boom cylinder 5.

The pilot lines P7, P8, P9, and P10 are provided with boom pressure sensors 32*a*, 32*b*, 32*c*, and 32*d*, and the actual pilot pressure detected by each pressure sensor is output to the controller 100.

The controller 100 generates a command current in accordance with the operation signal from the seventh potentiometer 67, and outputs the command current to the solenoid portion of the bucket solenoid proportional valve 44*a* to drive the bucket solenoid proportional valve 44*a*. The bucket solenoid proportional valve 44*a* generates a pilot pressure using the delivery pressure from the pilot pump 27 as the original pressure, and outputs the pilot pressure to one side operation portion of the bucket directional control valve 26 via the pilot line P15 to drive the spool of the bucket directional control valve 26 to the other side. As a result, the hydraulic fluid from the hydraulic pump 8*a* is supplied to the bottom side of the bucket cylinder 7 via the bucket directional control valve 26 to expand the bucket cylinder 7.

The controller 100 generates a command current in accordance with the operation signal from the eighth potentiometer 68, and outputs the command current to the solenoid portion of the bucket solenoid proportional valve 44*b* to drive the bucket solenoid proportional valve 44*b*. The bucket solenoid proportional valve 44*b* generates a pilot pressure using the delivery pressure from the pilot pump 27 as the original pressure, and outputs the pilot pressure to the other side operation portion of the bucket directional control valve 26 via the pilot line P16 to drive the spool of the bucket directional control valve 26 to one side. As a result, the hydraulic fluid from the hydraulic pump 8*a* is supplied to the rod side of the bucket cylinder 7 via the bucket directional control valve 26 to contract the bucket cylinder 7.

The pilot lines P15 and P16 are provided with bucket pressure sensors 34*a* and 34*b*, and the actual pilot pressure detected by each pressure sensor is output to the controller 100.

The controller 100 determines whether or not abnormality has been generated in each solenoid proportional valve based on the command current of each solenoid proportional valve and the actual pilot pressure detected by the pressure sensor on the secondary side thereof. In the case where it is determined that abnormality has been generated in the solenoid proportional valves, the abnormal state of the solenoid proportional valves is displayed on a display device 50 to inform the operator of the situation.

Further input to the controller 100 from a semiautomatic mode switch 160 is a signal indicating whether or not a semiautomatic mode has been selected. Here, the semiautomatic mode means a mode in which semiautomatic control is performed. The semiautomatic control is a control technique which assists the lever operation of the operator. Mainly on the construction site, it aims to perform control such that the claw tip of the bucket extends along the construction target surface specified in the design drawing, or that the claw tip of the bucket does not get beyond the construction target surface.

On the delivery side of the pilot pump 27, there is provided a relief valve 28 determining the upper limit value of the delivery pressure of the pilot pump 27. Between the pilot pump 27 and the first through fourth pilot valves and the solenoid proportional valves 41*a*, 41*b*, 42*a* through 42*d*, 43*a* through 43*d*, 44*a*, and 44*b*, there is provided a gate lock valve 29.

In the case where the gate lock lever 16 is operated to the raised position (lock position) permitting the getting on and off of the operator, the gate lock valve 29 places the switch in the open position, and so as not to excite the solenoid portion of the gate lock valve 29, the gate lock valve 29 is placed in the neutral position as shown in the lower side of the drawing. As a result, the hydraulic fluid supply from the pilot pump 27 to the first through fourth pilot valves and the solenoid proportional valves 41*a*, 41*b*, 42*a* through 42*d*, 43*a* through 43*d*, 44*a*, and 44*b* is interrupted. Thus, the hydraulic actuators become incapable of operating.

On the other hand, in the case where the gate lock lever 16 is operated to the lowered position (lock releasing position) where the getting on and off of the operator is prohibited, the gate lock valve 29 places the switch in the closed position, and to excite the solenoid portion of the gate lock valve 29, the gate lock valve 29 is placed in the switched position in the upper side of the drawing. As a result, the hydraulic fluid is supplied from the pilot pump 27 to the first through fourth pilot valves and the solenoid proportional valves 41*a*, 41*b*, 42*a* through 42*d*, 43*a* through 43*d*, 44*a*, and 44*b*. Thus, the hydraulic actuators become capable of operating.

Figure 3:
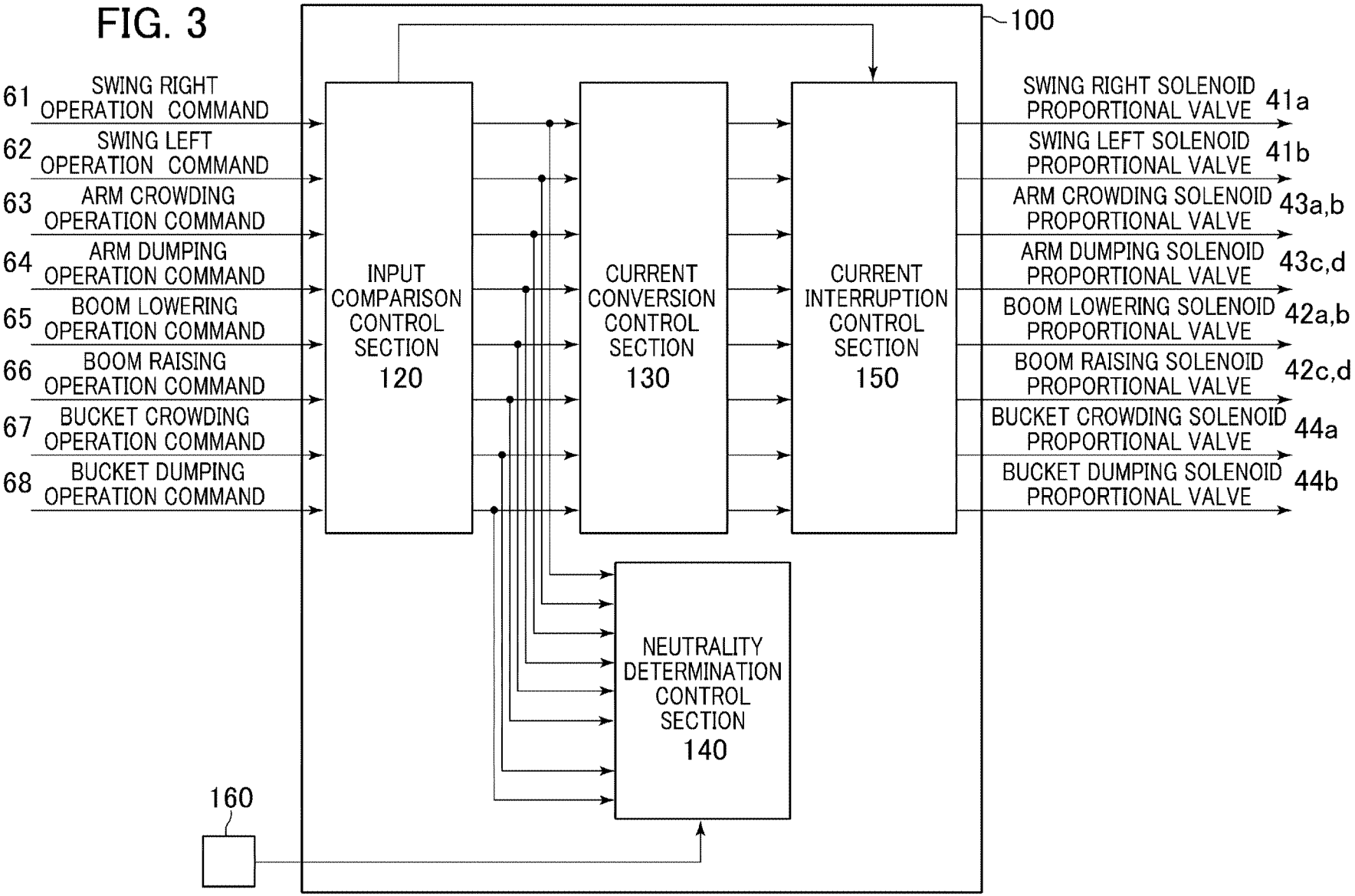
FIG. 3 is a conceptual drawing illustrating the overall structure of a controller constituting an embodiment of the construction machine of the present invention.
Figure 5:
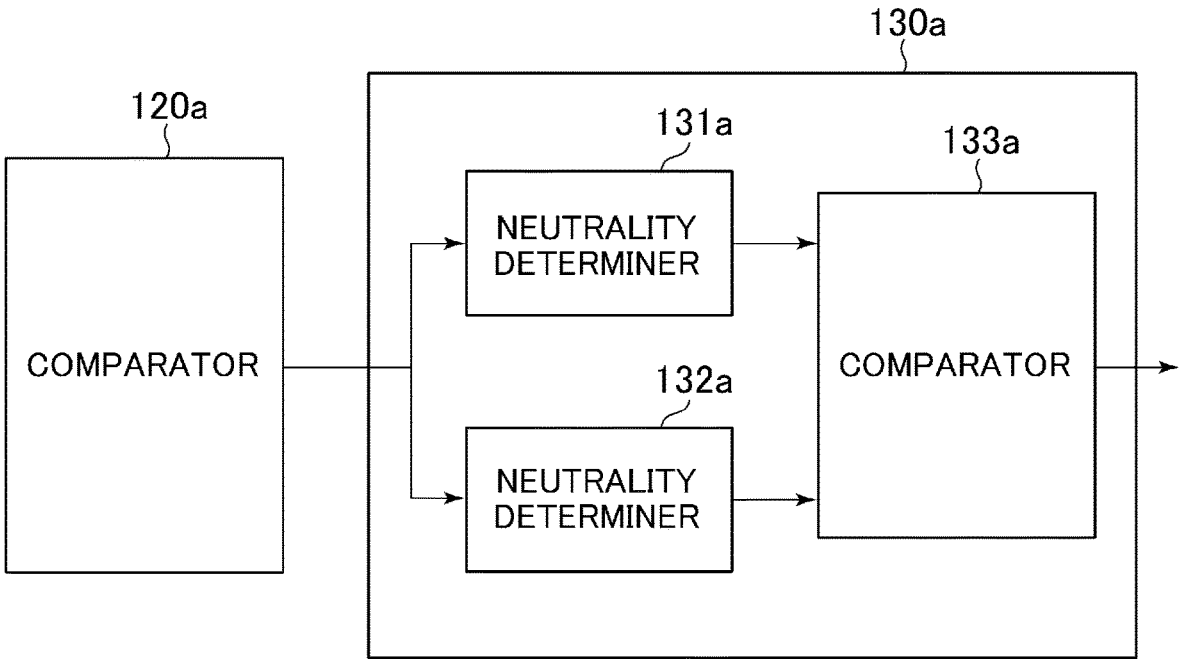
FIG. 5 is a control block diagram illustrating the structure of a lever neutrality determination section of the controller constituting an embodiment of the construction machine of the present invention.
Figure 6:
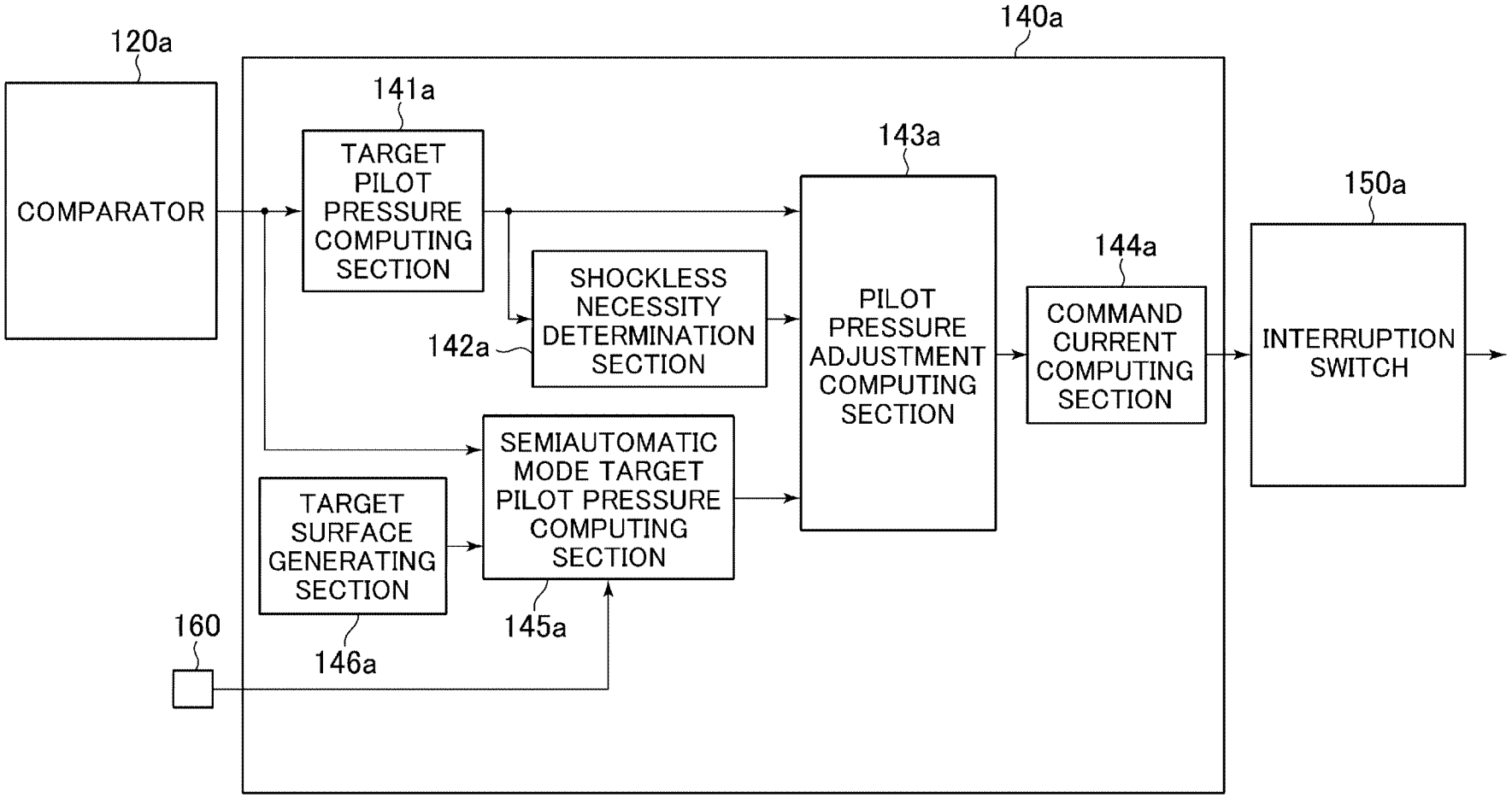
FIG. 6 is a control block diagram illustrating the structure of a current converter of the controller constituting an embodiment of the construction machine of the present invention.
Figure 7:
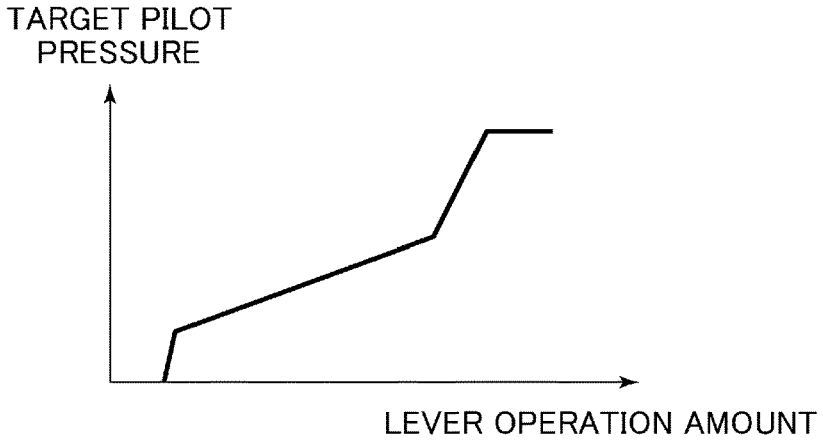
FIG. 7 is a characteristic chart illustrating the characteristics set in a target pilot pressure computing section of the controller constituting an embodiment of the construction machine of the present invention.
Figure 8:
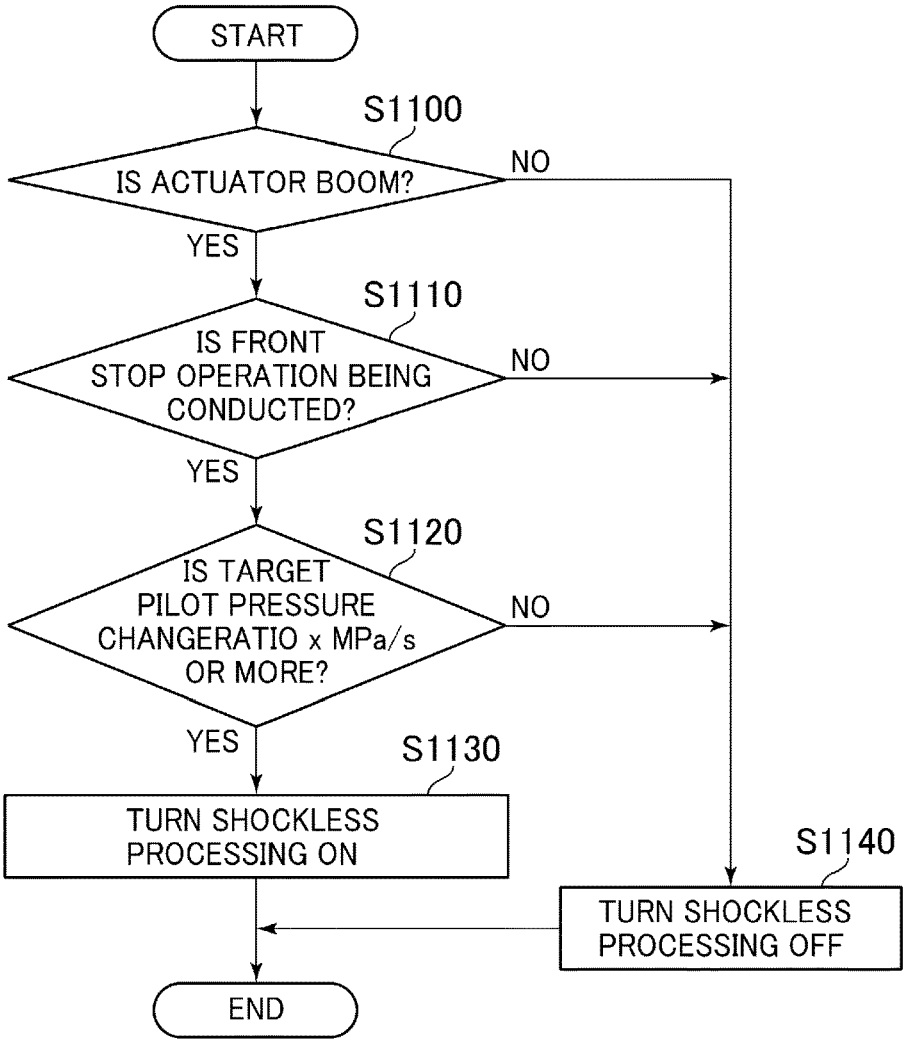
FIG. 8 is a flowchart illustrating the processing of a shockless necessity determination section of the controller constituting an embodiment of the construction machine of the present invention.
Figure 9A:
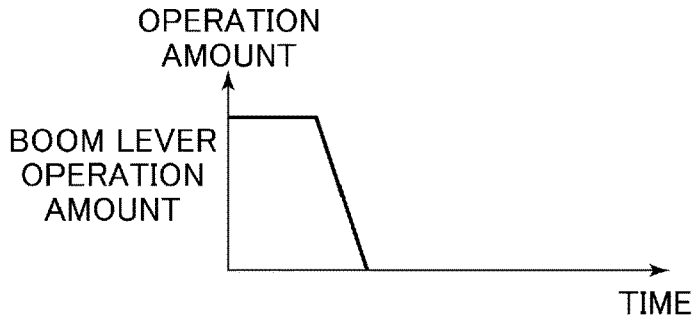
FIG. 9 is a characteristic chart for illustrating a shockless processing of the controller constituting an embodiment of the construction machine of the present invention.
Figure 9B:
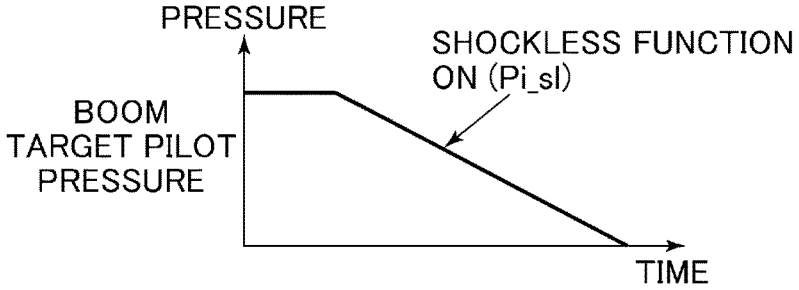
Figure 9C:
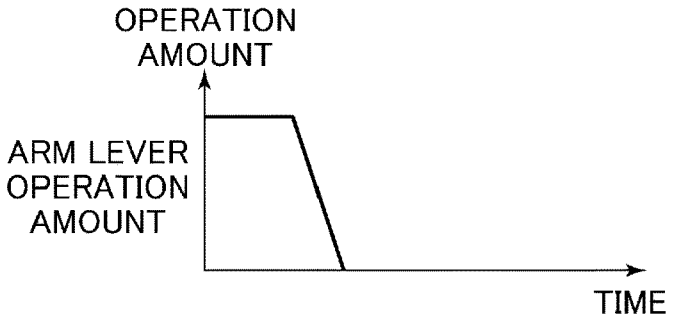
Figure 9D:
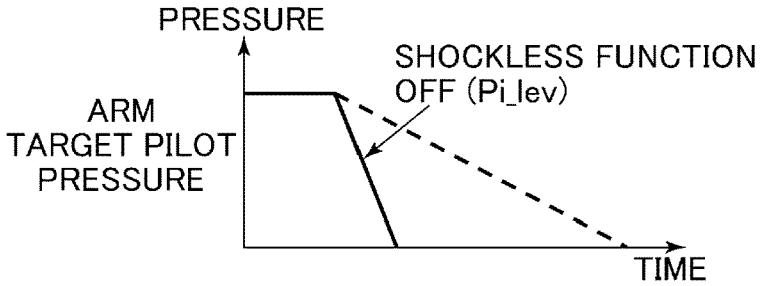
Figure 10:
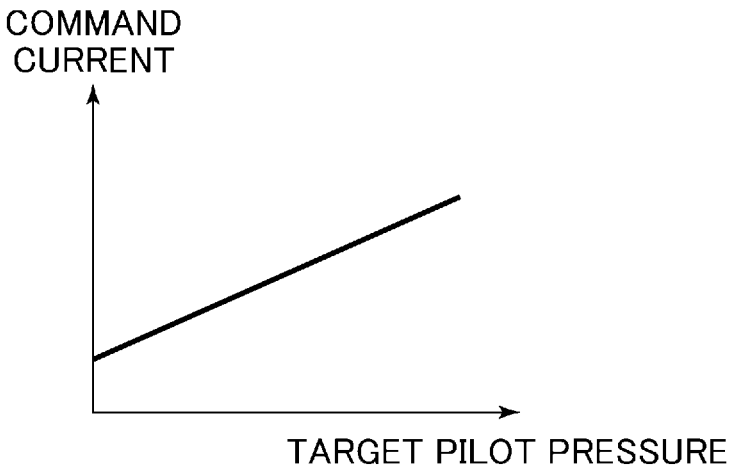
FIG. 10 is a characteristic chart illustrating characteristics set in a command current computing section of the controller constituting an embodiment of the construction machine of the present invention.

Next, the controller constituting an embodiment of the construction machine of the present invention will be described with reference to the drawings. FIG. 3 is a conceptual drawing illustrating the overall structure of a controller constituting an embodiment of the construction machine of the present invention, FIG. 4 is a control block diagram illustrating an example of the functions of the controller constituting an embodiment of the construction machine of the present invention, FIG. 5 is a control block diagram illustrating the structure of a lever neutrality determination section of the controller constituting an embodiment of the construction machine of the present invention, FIG. 6 is a control block diagram illustrating the structure of a current converter of the controller constituting an embodiment of the construction machine of the present invention, FIG. 7 is a characteristic chart illustrating the characteristics set in a target pilot pressure computing section of the controller constituting an embodiment of the construction machine of the present invention, FIG. 8 is a flowchart illustrating the processing of a shockless necessity determination section of the controller constituting an embodiment of the construction machine of the present invention, FIG. 9 is a characteristic chart for illustrating a shockless processing of the controller constituting an embodiment of the construction machine of the present invention, and FIG. 10 is a characteristic chart illustrating characteristics set in a command current computing section of the controller constituting an embodiment of the construction machine of the present invention.

In the embodiment of the present invention, the lever neutrality determination condition is changed in accordance with the presence/absence of the semiautomatic control and the necessity of the shockless function. Thus, the neutrality determination logic is not realized solely by hardware (electric circuit) as in the prior art technique. Instead, it is realized by the controller 100 presupposing electronic control. The embodiment of the present invention aims to achieve an improvement in terms of the safety of the machine body, and requires reliability equivalent to that of the prior art technique. It should be noted, however, that generally speaking, the electronic components constituting the controller such as a microprocessor and memory are more subject to failure as compared with a simple electric circuit. In view of this, in the controller 100, an improvement in terms of reliability is achieved through duplication or the like of the electronic control components corresponding to the computation processing and the processing.

As shown in FIG. 3, the controller 100 includes: an input comparison control section 120 equipped with a plurality of comparators which input operation command signals from the potentiometers 61 through 68 provided in the work operation devices 2*a* and 2*b* of the electric lever type (two sensor signals are input with respect to one operation command), which compare two sensor signals, which output an abnormality signal in the case where the deviation is not less than a threshold value, and which output the average value thereof in the normal case; a neutrality determination control section 130 which determines the neutrality of the electric lever signal based on the output signal (lever operation amount signal) from the input comparison control section 120; a current conversion control section 140 equipped with a plurality of current converters which output a command current to the solenoid proportional valves 41*a*, 41*b*, 42*a*, 42*b*, 42*c*, 42*d*, 43*a*, 43*b*, 43*c*, 43*d*, 44*a*, and 44*b* from the presence/absence of the semiautomatic control, the necessity of the shockless function, etc. based on the output signal (lever operation amount signal) from the input comparison control section 120; and a current interruption control section 150 equipped with a plurality of interruption switches inputting the abnormality signal from the input comparison control section 120, the neutrality determination signal from the neutrality determination control section, and the command current to the solenoid proportional valves from the current conversion control section 140 and controlling the interruption and communication of the command current to the solenoid proportional valves in accordance with the abnormality signal and the neutrality determination signal. Input to the neutrality determination control section 130 from the semiautomatic mode switch 160 is a signal indicating whether or not the semiautomatic mode has been selected.

Figure 4:
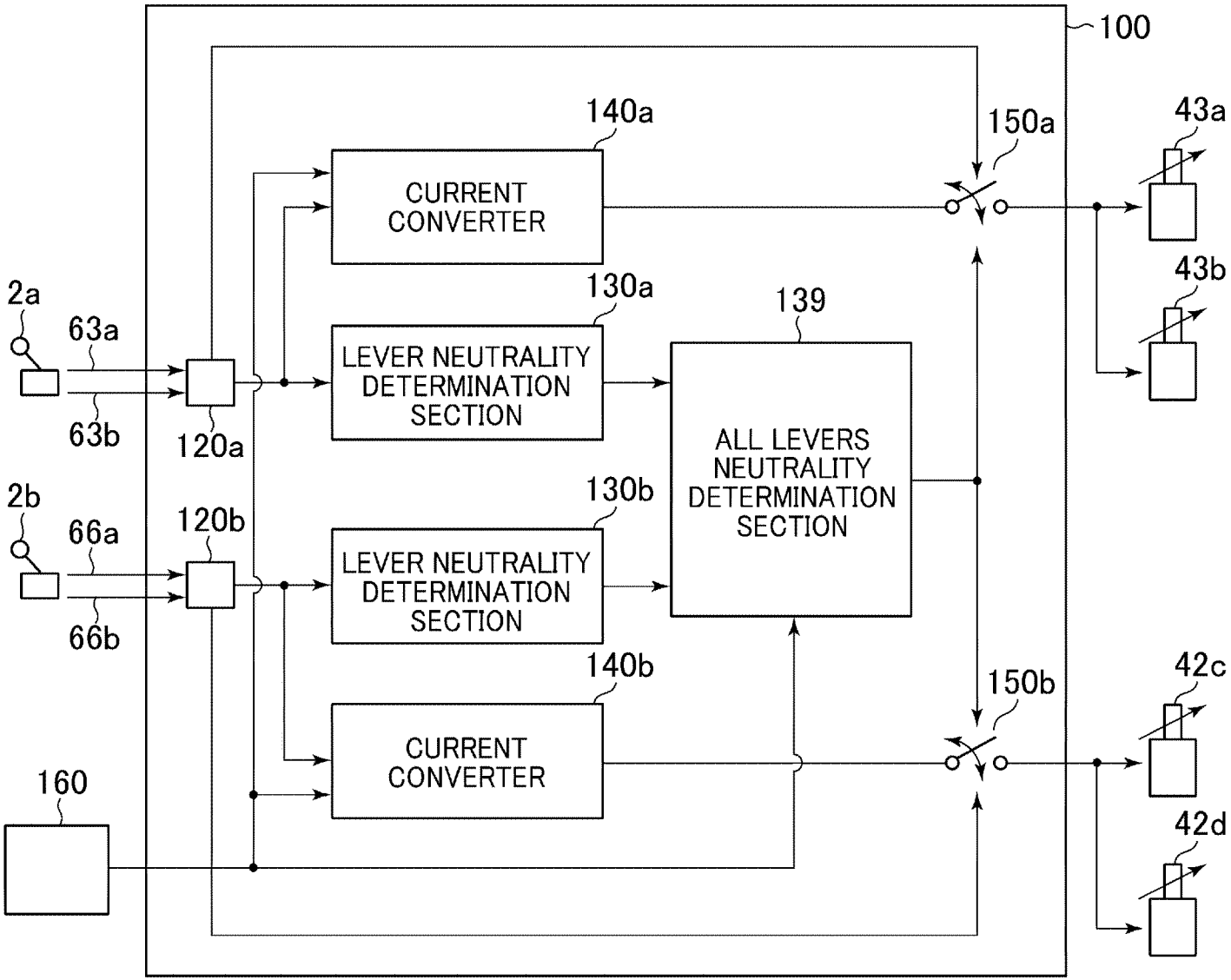
FIG. 4 is a control block diagram illustrating an example of the functions of the controller constituting an embodiment of the construction machine of the present invention.

FIG. 4 is a diagram illustrating, as an example of the function of the controller 100, the control block in the case where the arm crowding command and the boom raising command are generated. In FIG. 4, the controller 100 includes: a comparator 120*a* inputting an arm crowding operation command signal from the two potentiometers 63*a* and 63*b* provided in the work operation device 2*a*; a lever neutrality determination section 130*a* determining the neutrality of the electric lever signal based on the output signal (lever operation amount signal) from the comparator 120*a*; an all levers neutrality determination section 139 inputting neutrality determination signals from the lever neutrality determination section 130*a* and the other lever neutrality determination sections and a signal from the semiautomatic mode switch 160 and outputting neutrality determination signals for all modes; a current converter 140*a* outputting a command current to the arm solenoid proportional valves 43*a* and 43*b* based on the output signal (lever operation amount signal) from the comparator 120*a* and the signal from the semiautomatic mode switch 160; and an interruption switch 150*a* inputting an abnormality signal from the comparator 120*a*, a neutrality determination signal from the all levers neutrality determination section 139, and a command current from the current converter 140*a* to the solenoid proportional valves and controlling the interruption and communication of the command current to the arm solenoid proportional valves 43*a* and 43*b* in accordance with the abnormality signal and the neutrality determination signal.

Similarly, the controller 100 includes: a comparator 120*b* inputting boom raising operation command signals from two potentiometers 66*a* and 66*b* provided in the work operation device 2*b*; a lever neutrality determination section 130*b* determining the neutrality of the electric lever signal based on the output signal (lever operation amount signal) from the comparator 120*b*; a current converter 140*b* outputting a command current to the boom raising solenoid proportional valves 42*c* and 42*d* based on the output signal from the comparator 120*b* and the signal from the semiautomatic mode switch 160; and an interruption switch 150*b* inputting an abnormality signal from the comparator 120*b*, a neutrality determination signal from the all levers neutrality determination section 139, and a command current from the current converter 140*b* to the solenoid proportional valves, and controlling the interruption and communication of the command current to the boom raising solenoid proportional valves 42*c* and 42*d* in accordance with the abnormality signal and the neutrality determination signal.

Here, the comparator 120*a*, the lever neutrality determination section 130*a*, the current converter 140*a*, the interruption switch 150*a*, and the all levers neutrality determination section 139 will be described. Regarding the comparator 120*b*, the lever neutrality determination section 130*b*, the current converter 140*b*, and the interruption switch 150*b*, they are of the same functions as those of the above, so a description thereof will be left out.

The comparator 120*a* compares the sensor input values from the two potentiometers 63*a* and 63*b*, thereby achieving an improvement in terms of the reliability of the sensor signal. The comparator 120*a* compares the two sensor input values, and when the difference between them is less than a previously determined threshold value, outputs the average value of the two sensor input values to the lever neutrality determination section 130*a* and the current converter 140*a* as the lever operation amount signal. On the other hand, in the case where the difference between the two sensor input values is not less than the threshold value, it is determined that the sensor is abnormal, and an abnormality signal is output to the interruption switch 150*a*, interrupting the current output from the current converter 140*a* to the arm solenoid proportional valves 43*a* and 43*b*. Further, at this time, a sensor signal corresponding to the lever neutral position is output as the lever operation amount signal to the lever neutrality determination section 130*a* and the current converter 140*a*.

The lever neutrality determination section 130*a* determines whether or not the electric lever is in the neutral state. In the case where it is determined that it is in the neutral state, a current interruption command is output to the interruption switch 150*a* via the all levers neutrality determination section 139. Here, the neutral state is a state in which the lever operation amount signals (the sensor input values from the potentiometers 63*a* and 63*b*) are sufficiently small, indicating that the operator is not operating the hydraulic actuators.

FIG. 5 shows the lever neutrality determination section 130*a* in detail. The lever neutrality determination section 130*a* duplicates the computation section in order to achieve an enhancement in the reliability of the processing, and is equipped with two neutrality determiners 131*a* and 132*a* and a comparator 133*a*. The comparator 133*a* inputs the determination results from the two neutrality determiners 131*a* and 132*a*, and compares them before outputting the following signal. In the case where the determination results of the two neutrality determiners 131*a* and 132*a* are both neutral, a current interruption command is output to the interruption switch 150*a* via the all levers neutrality determination section 139. In the case where the determination results are both non-neutral, a current communication command is output to the interruption switch 150*a* via the all levers neutrality determination section 139, making it possible to output a current. In the case where the determination results of the two neutrality determiners 131*a* and 132*a* differ from each other, the comparator 133*a* outputs a current interruption command to the interruption switch 150*a* via the all levers neutrality determination section 139. In the present embodiment, the electric lever signal input processing and the lever neutrality determination are duplicated, thereby achieving an improvement in terms of reliability.

The all levers neutrality determination section 139 inputs a signal from the semiautomatic mode switch 160 selecting ON/OFF of the semiautomatic control, and a neutrality determination signal from the lever neutrality determination section corresponding to all the operation command signals. When the semiautomatic mode switch 160 is OFF, a current interruption signal is output to the interruption switch in accordance with a neutrality determination signal for each hydraulic actuator. On the other hand, when the semiautomatic mode switch 160 is ON, only in the case where the neutrality determination signals for all the hydraulic actuators are determined to be neutral, is a current interruption output to all the interruption switches.

Referring back to FIG. 4, the current converter 140*a* is equipped with an output current map with respect to the lever operation amount signal, and outputs a current for driving the solenoid proportional valves in accordance with a lever operation amount signal.

FIG. 6 shows the current converter 140*a* in detail. The current converter 140*a* is equipped with a target pilot pressure computing section 141*a*, a shockless necessity determination section 142*a*, a pilot pressure adjustment computing section 143*a*, a command current computing section 144*a*, a semiautomatic mode target pilot pressure computing section 145*a*, and a target surface generating section 146*a*.

The target pilot pressure computing section 141*a* inputs the lever operation amount signal from the comparator 120*a*, and outputs a target pilot pressure signal in accordance with the target pilot pressure characteristic with respect to the previously set lever operation amount to the shockless necessity determination section 142*a* and the pilot pressure adjustment computing section 143*a*. FIG. 7 shows an example of the previously set characteristic of the target pilot pressure computing section 141*a*.

Referring back to FIG. 6, the shockless necessity determination section 142*a* inputs the target pilot pressure signal calculated by the target pilot pressure computing section 141*a*, and when the operation lever is abruptly operated, determines whether or not to restrict the time change ratio of the target pilot pressure of the corresponding actuator. More specifically, when the hydraulic actuator is one requiring shockless processing and the time change ratio of the lever operation amount is a predetermined value (e.g., x MPa/s) or more, it is determined that shockless processing is necessary. If the hydraulic actuator is one requiring no shockless processing, or even if the hydraulic actuator is one requiring shockless processing, when the time change ratio of the lever operation amount is less than the predetermined value, it is determined that no shockless processing is necessary. A shockless necessity signal resulting from the determination is output to the pilot pressure adjustment computing section 143*a*.

Generally speaking, the vibration (shock) of the machine body increases when the operation lever is abruptly returned to the neutral position during the boom raising operation. Thus, in the present embodiment, there will be described an example in which the hydraulic actuator on which the shockless processing is executed is the boom cylinder 5.

The processing of the shockless necessity determination section 142*a* will be described with reference to FIG. 8.

The shockless necessity determination section 142*a* determines whether or not the hydraulic actuator being operated is the boom cylinder 5 (step S1100). In the case where the hydraulic actuator is the boom cylinder 5, the procedure advances to step S1110. Otherwise, the procedure advances to step S1140.

In the case where the hydraulic actuator is the boom cylinder 5, the shockless necessity determination section 142*a* determines whether or not the front device stopping operation is being performed (step S1110). Here, the front device stopping operation means the operation of returning the operation lever to the neutral state from the non-neutral state in order to stop the work device 12. In the case where the front device stopping operation is being performed, the procedure advances to step S1120. Otherwise, the procedure advances to step S1140.

In the case where the front device stopping operation is being performed, the shockless necessity determination section 142*a* determines whether or not the target pilot pressure change ratio is the previously set x MPa/s or more (step S1120). In the case where the target pilot pressure change ratio is x MPa/s or more, the procedure advances to step S1130. Otherwise, the procedure advances to step S1140.

In the case where the target pilot pressure change ratio is x MPa/s or more, the shockless necessity determination section 142*a* turns ON the shockless processing (step S1130). More specifically, it outputs a shockless necessary signal to the pilot pressure adjustment computing section 143*a*.

In the case where the determination is made otherwise, in any of step S1100, step S1110, and step S1120, the shockless necessity determination section 142*a* turns OFF the shockless processing (step S1140). More specifically, it outputs a shockless unnecessary signal to the pilot pressure adjustment computing section 143*a*.

Referring back to FIG. 6, the pilot pressure adjustment computing section 143*a* inputs the target pilot pressure output by the target pilot pressure computing section 141*a* and the determination result output by the shockless necessity determination section 142*a*, and determines the target pilot pressure value to be output to the command current computing section 144*a*.

The difference in output depending on the presence/absence of shockless processing in the pilot pressure adjustment computing section 143*a* will be described with reference to FIG. 9. In FIG. 9, the horizontal axes indicate time, and the vertical axes indicate (a) boom lever operation amount, (b) boom cylinder target pilot pressure, (c) arm lever operation amount, and (d) arm cylinder target pilot pressure.

In the boom cylinder 5 in which the shockless processing is executed, in the case where the target pilot pressure change ratio in the target pilot pressure computing section 141*a* is x MPa/s or more due to the lever operation amount shown in portion (a), the shockless necessary signal is input to the pilot pressure adjustment computing section 143*a* from the shockless necessity determination section 142*a*, and the pilot pressure adjustment computing section 143*a* outputs a target pilot pressure signal (Pi_sl) having undergone a change ratio restriction in which the shockless function is turned ON as shown in portion (b) based on the target pilot pressure signal input from the target pilot pressure computing section 141*a*.

On the other hand, in the arm cylinder 6 in which no shockless processing is executed, independently of the lever operation amount change ratio shown in portion (c), the shockless unnecessary signal is input from the shockless necessity determination section 142*a* to the pilot pressure adjustment computing section 143*a*, and the pilot pressure adjustment computing section 143*a* outputs a target pilot pressure signal (Pi_lev) input from the target pilot pressure computing section 141*a*.

Referring back to FIG. 6, the command current computing section 144*a* inputs the target pilot pressure signal from the pilot pressure adjustment computing section 143*a*, and outputs a command current signal with respect to a previously set target pilot pressure to the solenoid portion of the corresponding solenoid proportional valve via the interruption switch 150*a*. FIG. 10 shows an example of the previously set characteristic of the command current computing section 144*a*.

Referring back to FIG. 6, the semiautomatic mode target pilot pressure computing section 145*a* inputs the lever operation amount signal from the comparator 120*a*, the construction target surface information from the target surface generating section 146*a*, and a semiautomatic control ON/OFF selection signal from the semiautomatic mode switch 160. When the semiautomatic control is ON, it computes the target pilot pressure signal from the lever operation amount and the construction target surface information, and outputs it to the pilot pressure adjustment computing section 143*a*. The target surface generating section 146*a* stores information on the target surface specified in the design drawing.

For example, in the state in which the operator is operating the arm 18, the semiautomatic mode target pilot pressure computing section 145*a* computes a target pilot pressure for automatically controlling the boom 17 such that the claw tip of the bucket 19 does not get beyond the construction target surface, and outputs it to the pilot pressure adjustment computing section 143*a*.

Figure 11:
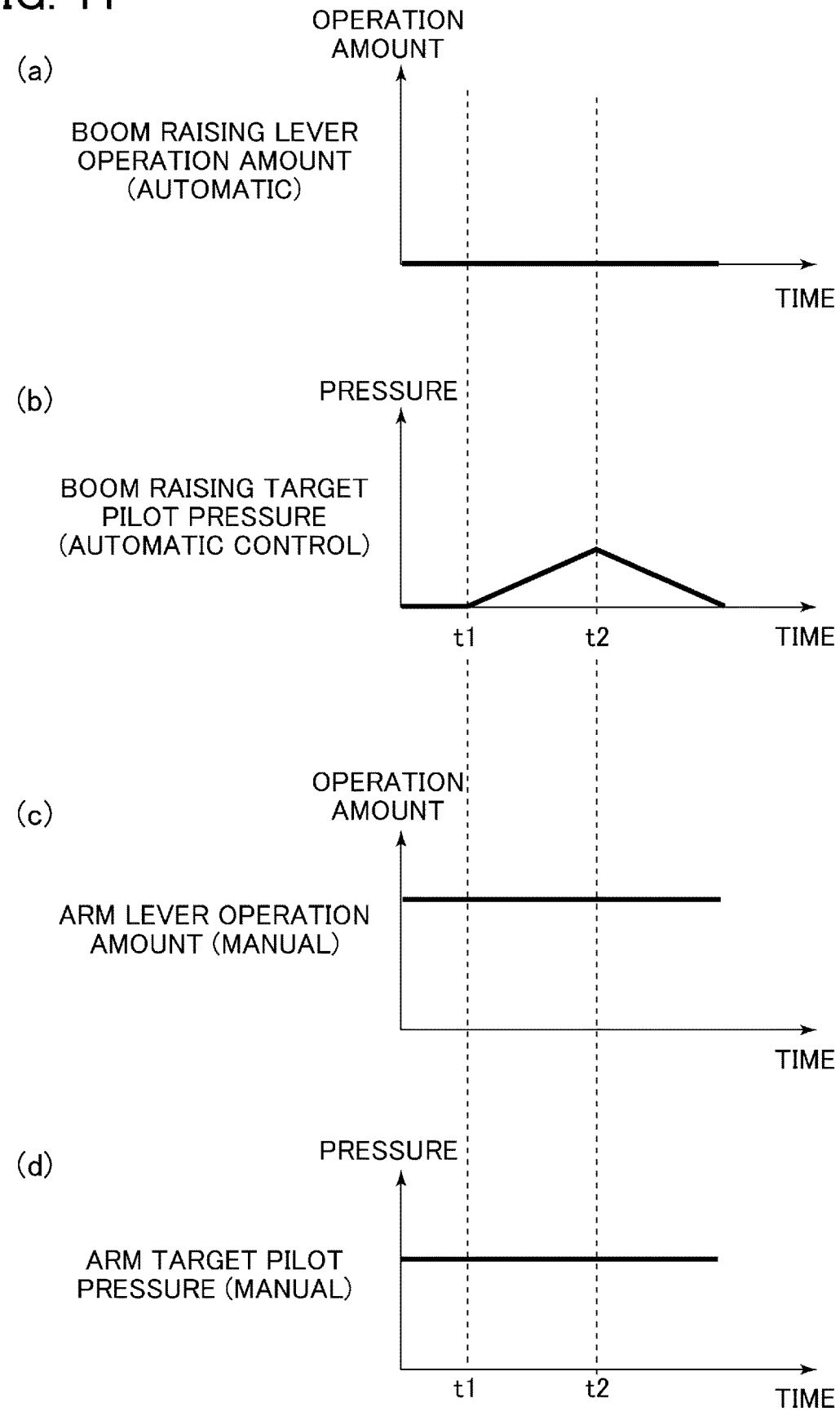
FIG. 11 is a characteristic chart for illustrating an operation example of a semiautomatic control of the controller constituting an embodiment of the construction machine of the present invention.

The operation of the target pilot pressure of the semiautomatic mode target pilot pressure computing section 145*a* will be described with reference to FIG. 11. FIG. 11 is a characteristic chart for illustrating an operation example of a semiautomatic control of the controller constituting an embodiment of the construction machine of the present invention. In FIG. 11, the horizontal axes indicate time, and the vertical axes indicate (a) the boom raising lever operation amount (automatic), (b) the boom cylinder raising target pilot pressure (automatic), (c) the arm lever operation amount (manual), and (d) the arm cylinder target pilot pressure (manual).

In the example shown in FIG. 11, to be described will be the operation when leveling is performed in the semiautomatic control mode. As shown in portion (a), the boom 17 is under automatic control, so that the lever operation amount remains 0. As shown in portion (c), the lever operation amount of the arm 18 is manual and of a fixed value, and as shown in portion (d), the arm target pilot pressure is also a fixed value.

In this state, when time t1 is attained, the claw tip of the bucket 19 is about to get beyond the construction target surface, so that automatic control is applied, and, as shown in portion (b), the boom raising target pilot pressure increases, and the boom raising operation is performed. By thus assisting the operation of the operator, the claw tip of the bucket 19 is prevented from getting beyond the construction target surface. When time t1 is passed, and when time t2 is attained at which the distance between the target surface and the bucket claw tip is not less than a predetermined length, the increase in the boom raising target pilot pressure is stopped. After this, the boom raising operation is lowered through gradual decrease. The distance between the target surface and the claw tip of the bucket 19 is calculated from the signals from the posture sensors provided in the boom 17, the arm 18, and the bucket 19 and the construction target surface information from the target surface generating section 146*a*.

Figure 12:
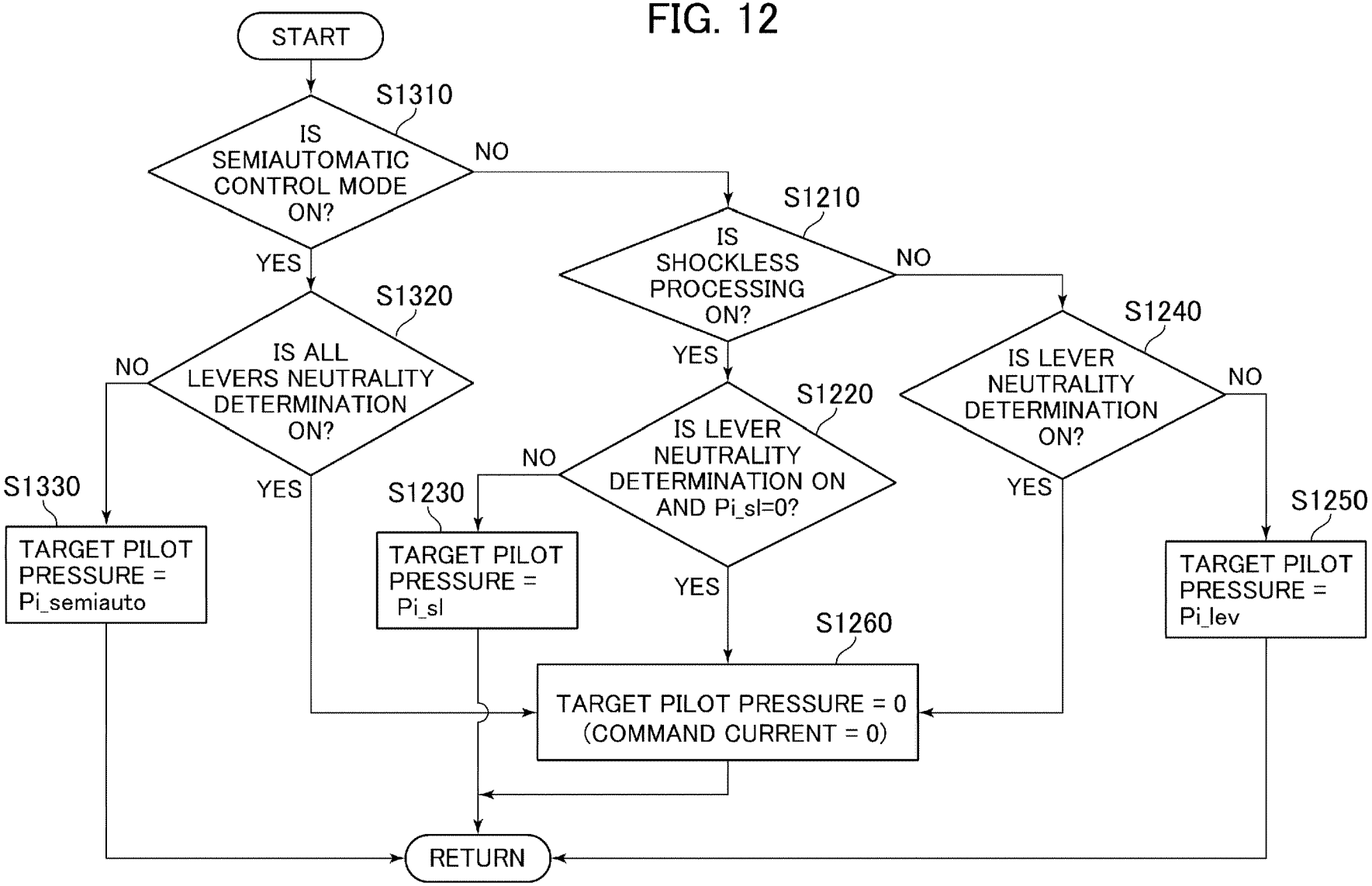
FIG. 12 is a flowchart illustrating the processing from lever signal input to a target pilot pressure computation of the controller constituting an embodiment of the construction machine of the present invention.

Next, the processing from the reception of the lever signal by the controller and the output of the target pilot pressure (the command current to the solenoid proportional valve) will be described with reference to FIG. 12. FIG. 12 is a flowchart illustrating the processing from lever signal input to a target pilot pressure computation of the controller constituting an embodiment of the construction machine of the present invention.

The controller 100 determines whether or not the semiautomatic control mode is ON (step S1310). More specifically, the determination is made from the semiautomatic ON/OFF selection signal from the semiautomatic mode switch 160 input. In the case where the semiautomatic control mode is ON, the procedure advances to step S1320. Otherwise, the procedure advances to step S1210.

In the case where the semiautomatic control mode is ON, the controller 100 determines whether or not the all lever neutrality determination is ON (step S1320). More specifically, it is determined whether or not all the operation levers are neutral. In the case where it is determined that all the levers are neutral, the procedure advances to step S1260. Otherwise, the procedure advances to step S1330.

In the case where the controller 100 determines that at least one operation lever is not neutral, the semiautomatic mode target pilot pressure computing section 145*a* outputs a target pilot pressure Pi_semiauto (step S1330). As a result, through the semiautomatic control, the command current can be supplied to the solenoid proportional valve driving the corresponding hydraulic actuator.

In the case where it is determined in step S1310 that the semiautomatic control mode is not ON, the controller 100 determines whether or not to execute the shockless processing (step S1210). More specifically, it is determined based on the processing of the shockless necessity determination section 142*a* shown in FIG. 8. In the case where the shockless processing is to be executed, the procedure advances to step S1220. Otherwise, the procedure advances to step S1240.

In the case where the shockless processing is to be executed, the controller 100 performs the lever neutrality determination processing to determine whether or not the levers are neutral, and determines whether or not the target pilot pressure Pi_sl after the shockless processing is 0 (step S1220). In the case where the determination result of the step S1220 is YES, the procedure advances to step S1260. Otherwise, the procedure advances to step S1230.

In the case where the determination result of step S1220 is NO, the controller 100 sets the target pilot pressure to Pi_sl and outputs the same (step S1230). As a result, due to the target pilot pressure signal that has undergone a change ratio restriction, the command current can be supplied to the solenoid proportional valve driving the corresponding hydraulic actuator. As a result, in the case where, for example, the shockless processing for suppressing the machine body vibration is executed, the pilot pressure OFF processing due to the lever neutrality is not executed until the processing is completed, so that the stability of the machine body is enhanced.

In the case where it is determined in step S1210 that the shockless processing is not to be executed, the controller 100 makes the lever neutrality determination to determine whether or not the levers are neutral (step S1240). In the case where, as a result of the lever neutrality determination, it is determined that the levers are neutral, the procedure advances to step S1260. Otherwise, the procedure advances to step S1250.

In the case where, as a result of the lever neutrality determination in step S1240 it is determined that the levers are not neutral, the controller 100 sets the target pilot pressure to Pi_lev and outputs the same (step S1250). As a result, due to the target pilot pressure signal that has not undergone the change ratio restriction, the command current can be supplied to the solenoid proportional valve driving the corresponding hydraulic actuator.

In the case where the all lever neutrality determination is ON in step S1320, or in the case where the determination result of step S1220 is YES, or in the case where the levers are determined to be neutral through the lever neutrality determination in step S1240, the controller 100 sets the target pilot pressure to 0, and outputs the same (step S1260). This is a command current OFF processing, which is executed immediately after the lever neutrality determination on a hydraulic actuator not requiring the shockless processing. Thus, there is generated the effect of enhancing the safety of the electric lever type construction machine.

After the execution of the processing of one of step S1330, step S1230, step S1250, and step S1260, the procedure of the controller 100 advances to RETURN, and similar processing is repeated starting from step S1310.

In the present embodiment described above, in the semiautomatic control, control intervention for assisting the operator is permitted in relation to the target construction surface with respect to a hydraulic actuator allowing intervention of automatic control. In the other cases, it is possible to quickly execute the pilot pressure OFF processing in accordance with the lever neutrality determination, whereby it is possible to secure the requisite safety.

In the embodiment of the construction machine of the present invention described above, at the time of semiautomatic control, it is possible to secure the safety of the machine body while permitting control intervention.

While in the present embodiment described above there is provided a hydraulic pilot type traveling operation device, this should not be construed restrictively. There may be also provided an electric lever type traveling operation device.

Further, while in the example described above the hydraulic actuator on which the shockless processing is executed is restricted to the boom cylinder, this should not be construed restrictively. For example, in the case where the vibration at the time of abrupt operation of the arm cylinder is to be suppressed, the shockless processing may be executed on the arm cylinder.

Further, while the boom raising operation has been described as an example of the semiautomatic control, this should not be construed restrictively. In the case where the present invention is applied to the bucket, in, for example, a site preparation work called leveling work, there is to be presupposed a scene in which automatic control intervention is effected in the control for making the angle of the bucket with respect to the ground a fixed angle. In this case, the same processing as the above-described boom raising automatic control is executed in the control of the bucket, whereby it is possible to attain the effect of the construction machine according to the present invention.

DESCRIPTION OF THE REFERENCE CHARACTERS

1*a*, 1*b*: Traveling operation device
2*a*, 2*b*: Work operation device
3*a*, 3*b*: Traveling hydraulic motor
4: Swing motor
5: Boom cylinder
6: Arm cylinder
7: Bucket cylinder
8*a*, 8*b*, 8*c*: Hydraulic pump
9*a*, 9*b*, 9*c*: Pump regulator
10: Lower track structure
11: Upper swing structure
12: Work device
13*a*, 13*b*: Traveling device
14: Cab
15: Engine
16: Gate lock lever
17: Boom
18: Arm
19: Bucket
20: Control valve
21: Left traveling directional control valve
22: Right traveling directional control valve
23: Swing directional control valve
24*a*, 24*b*: Boom directional control valve

25*a*, 25*b*: Arm directional control valve
26: Bucket directional control valve
27: Pilot pump
28: Relief valve
29: Gate lock valve
31*a*, 31*b*: Swing pressure sensor
32*a*, 32*b*, 32*c*, 32*d*: Boom pressure sensor
33*a*, 33*b*, 33*c*, 33*d*: Arm pressure sensor
34*a*, 34*b*: Bucket pressure sensor
41*a*, 41*b*: Swing solenoid proportional valve
42*a*, 42*b*, 42*c*, 42*d*: Boom solenoid proportional valve
43*a*, 43*b*, 43*c*, 43*d*: Arm solenoid proportional valve
44*a*, 44*b*: Bucket solenoid proportional valve
45*a*, 45*b*: Traveling pilot valve
50: Display device
61, 62, 63, 64, 65, 66, 67, 68: Potentiometer
100 Controller
120: Input comparison control section
120*a*, 120*b*: Comparator
130: Neutrality determination control section
130*a*, 130*b*: Lever neutrality determination section
139: All levers neutrality determination section
140: Current conversion control section
140*a*, 140*b*: Current converter
141*a*: Target pilot pressure computing section
142*a*: Shockless necessity determination section
143*a*: Pilot pressure adjustment computing section
144*a*: Command current computing section
145*a*: Semiautomatic mode target pilot pressure computing section
146*a*: Target surface generating section
150: Current interruption control section
150*a*, 150*b*: Interruption switch
160: Semiautomatic mode switch

The invention claimed is:

1. A construction machine comprising: a plurality of hydraulic actuators; a plurality of operation levers corresponding to the plurality of hydraulic actuators; a plurality of operation lever devices outputting electric operation signals in accordance with operation amounts of the plurality of operation levers; a plurality of solenoid proportional valves connected to a hydraulic circuit driving each of the plurality of hydraulic actuators; and a controller receiving the output electric operation signals from the operation lever devices and having a processor coupled to a memory storing instructions that when executed by the processor configure the controller to compute control signals for the solenoid proportional valves and output the control signals;

wherein the controller is further configured to:

determine whether or not each of the operation levers are at a neutral position based on operation signals from the operation lever devices;

compute pilot pressures driving the hydraulic actuators based on the operation signals from the operation lever devices;

convert the computed pilot pressure signals to command current signals and output the command current signals to the solenoid proportional valves;

control interruption and communication of the output command current signals to the solenoid proportional valves;

determine whether the construction machine is in a manual operation state in which all of the plurality of hydraulic actuators are an object of manual operation by an operator, or in a semiautomatic operation state in which, based on a positional relationship between a bucket claw tip position and a construction target surface, at least one hydraulic actuator of the plurality of hydraulic actuators is controlled to assist the operation of the operator, upon determining that the construction machine is in the semiautomatic operation state and all of the operation levers of the plurality of operation lever devices are at the neutral position, interrupt the command current signals to all of the plurality of solenoid proportional valves, upon determining that the construction machine is in the semiautomatic operation state and at least one of the plurality of operation levers is not at the neutral position, communicate the command current signals to all of the plurality of solenoid proportional valves, and upon determining that the construction machine is in the manual operation state, interrupt the command current signals to the plurality of solenoid proportional valves according to the determination result of whether or not each of the operation levers are at a neutral position.

2. The construction machine according to claim 1, wherein the controller is further configured to, upon determining that the construction machine is in the semiautomatic operation state, communicate the command current signals to all of the plurality of solenoid proportional valves, with respect to at least one of hydraulic actuators of a boom cylinder and an arm cylinder, the operation lever of the corresponding operation lever device is determined to be at the neutral position, when all the operation levers of other operation lever devices are not determined to be at the neutral position.

3. The construction machine according to claim 1, wherein the controller is further configured to, upon determining that the construction machine is in a manual operation state, interrupt a command current signal to a solenoid proportional valve of a hydraulic actuator corresponding to an operation lever of the plurality of operation lever devices that is determined to be at the neutral position.

4. A construction machine comprising: a plurality of hydraulic actuators; a plurality of operation levers corresponding to the plurality of hydraulic actuators; a plurality of operation lever devices outputting electric operation signals in accordance with operation amounts of the plurality of operation levers; a plurality of solenoid proportional valves connected to a hydraulic circuit driving each of the plurality of hydraulic actuators; and a controller receiving the output electric operation signals from the operation lever devices and having a processor coupled to a memory storing instructions that when executed by the processor configure the controller to compute control signals for the solenoid proportional valves and output the control signals;

wherein the controller is further configured to:

determine whether or not each of the operation levers are at a neutral position based on operation signals from the plurality of operation lever devices;

compute pilot pressures driving the hydraulic actuators based on the operation signals from the operation lever devices;

convert the computed pilot pressure signals to command current signals and output the command current signals to the solenoid proportional valves;

control interruption and communication of the output command current signals to the solenoid proportional valves;

determine whether the construction machine is in a manual operation state in which all of the plurality of hydraulic actuators are an object of manual operation by an operator, or in a semiautomatic operation state in which, based on a positional relationship between a bucket claw tip position and a construction target surface, at least one hydraulic actuator of the plurality of hydraulic actuators is controlled to assist the operation of the operator;

determine a necessity of a shockless operation suppressing vibration of a machine body based on an operation of the operation lever and output a shockless operation signal when the shockless operation is determined to be necessary; and compute an adjusted pilot pressure based on the computed pilot pressure and the shockless operation signal, and output an adjusted pilot pressure signal, wherein the command current signal is generated on the basis of the adjusted pilot pressure signal, upon determining that the construction machine is in the semiautomatic operation state, interrupt the command current signals to all of the plurality of solenoid proportional valves only when it is determined that all of the operation levers of the plurality of operation lever devices are at the neutral position;

upon determining that the shockless operation is unnecessary, output, as the command current signal, the adjusted pilot pressure signal, and upon determining that the shockless operation is necessary, apply a change ratio restriction to the adjusted pilot pressure signal as the command current signal, and interrupt a current signal to a solenoid proportional valve of a hydraulic actuator corresponding to the operation lever when the operation lever of the operation lever device is determined to be at the neutral position and when the adjusted pilot pressure signal becomes a predetermined value or less.

* * * * *